US005774518A

United States Patent [19]

Kirby

[11] Patent Number: 5,774,518

[45] Date of Patent: Jun. 30, 1998

[54] DISCRETE TABLET COUNTING MACHINE

[76] Inventor: John Kirby, 610 S. 28th St. P.O. Box 124, Washougal, Wash. 98671

[21] Appl. No.: 791,288

[22] Filed: Jan. 30, 1997

[51] Int. Cl.[6] ..... G06M 7/00

[52] U.S. Cl. ..... 377/6; 377/7

[58] Field of Search ..... 377/6, 7

[56] References Cited

U.S. PATENT DOCUMENTS

| | | | |
|---|---|---|---|
| D. 337,539 | 7/1993 | Leamon . | |
| 3,789,194 | 1/1974 | Kirby | 235/92 |
| 3,900,718 | 8/1975 | Seward . | |
| 3,928,753 | 12/1975 | Kivett et al. . | |
| 3,983,373 | 9/1976 | Russell . | |
| 4,012,622 | 3/1977 | Boys | 235/92 |
| 4,027,143 | 5/1977 | Witriol et al. . | |
| 4,396,828 | 8/1983 | Dino et al. | 377/6 |
| 4,611,124 | 9/1986 | Schneider . | |
| 4,901,841 | 2/1990 | Haggerty et al. . | |
| 5,027,938 | 7/1991 | Haggarty et al. . | |
| 5,199,517 | 4/1993 | Kirby . | |
| 5,317,645 | 5/1994 | Perozek et al. . | |
| 5,473,703 | 12/1995 | Smith . | |

*Primary Examiner*—Margaret Rose Wambach
*Attorney, Agent, or Firm*—Marger, Johnson, McCollom & Stolowitz,PC

[57] ABSTRACT

A machine for counting discrete articles, such as tablets, pills, or capsules, comprising a feeder including a hopper for receiving and dispersing a plurality of tablets to be counted into separate streams, a plurality of detectors associated with each stream for detecting each tablet in that stream, a counter coupled to said plurality of counters for counting the total number of tablets in all of the streams and a switching device coupled to each of said plurality of detectors for preventing detector saturation and delay, thereby improving counter accuracy and speed.

15 Claims, 4 Drawing Sheets

Fig. 1
*PRIOR ART*
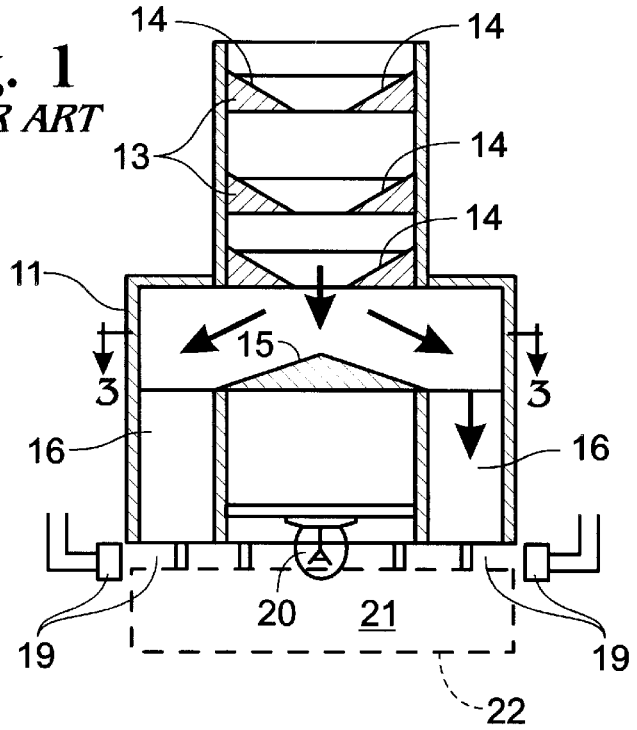
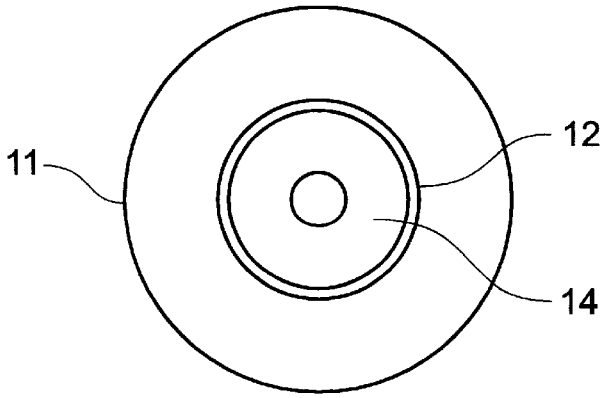
Fig. 2
*PRIOR ART*
Fig. 3
*PRIOR ART*
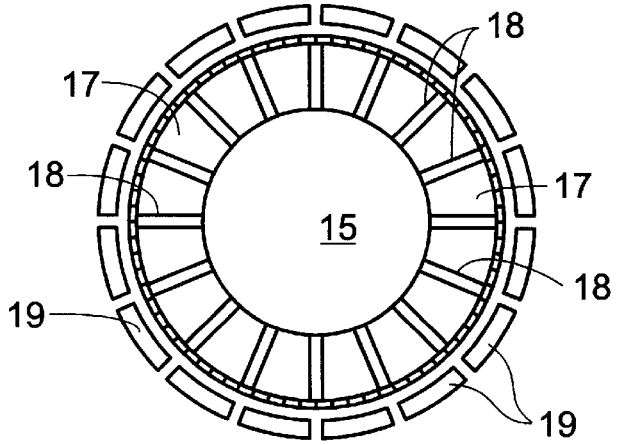

DISCRETE TABLET COUNTING MACHINE

BACKGROUND OF THE INVENTION

1. Field of the Invention

This invention relates generally to machines for counting discrete articles, and more particularly to opto-electric apparatus for counting tablets, pills, or capsules and the like.

2. State of the Art

The pharmaceutical industry, due to an ever-increasing demand for more reliable and uniform products, is experiencing an increasing need for automation processing and handling equipment. Among the specific needs being encountered by the industry is the necessity for a high speed, high accuracy apparatus to receive and count tablets, pills, or capsules.

Tablet counters and sorters are well known in the art. These types of devices all share a common goal of reducing a collection of discrete objects to an orderly line of flow so that they may be counted and/or sorted as they move past one or more optical sensors. Such devices take various forms including gravity feeds, rotational and linear vibrators, rotating discs, air jets, moving belts, etc. The gravity feed devices generally include a cone feeder for dispersing a flow of articles to be counted into separate streams, a means for feeding a substantially even flow of articles to one or more channels, an optical sensor to detect each tablet in a stream through each channel, and a counter fed by the outputs of the optical sensors for counting the total number of articles in all of the streams.

Several methods and devices have been used to detect and count tablets, pills, or capsules in gravity feed pill counters. An example of tablet counting apparatus can be found in U.S. Pat. No. 3,789,194, entitled "RELATING TO COUNTING MACHINES" to the present applicant, J. Kirby, granted Jan. 29, 1974. The counting machine described therein suffered from a variety of problems including poor counting accuracy and speed due to detecting circuit saturation, response delay, and lack of electrical signal noise immunity. The tablets, pills, or capsules encountered in routine usage vary in size over a wide range. Counting speed was limited to about 30 tablets per second at an error rate of 3 per thousand (0.003). This problem is further discussed below with reference to FIG. 5. Additionally, the counting machine had an unnecessary high level of complexity due to a high number of discrete components. The high number of components leads to increased reliability and serviceability problems.

An attempt was made to overcome some of these problems, by the development in 1983 of the improved detector, summing, and counting circuit shown in FIG. 6. This circuit increased the counting speed to about 40 tablets per second at an error rate of 0.003. It did not solve the complexity problem, and any attempt to further increase counting speed in this circuit results in a substantially increased error rate, particularly undercounting errors due to near coincident detections of tablets simultaneously passing through the channels.

Accordingly, a need remains for a tablet counter having both a high degree of accuracy and high counting speed.

SUMMARY OF THE INVENTION

An object of the present invention is to provide a tablet counter with a detector circuit which has a fast response time and is highly immune to electrical signal noise and undercounting due to near coincident detections.

Another object of this invention is the provision of a tablet counter having a minimum number of stages and electrical components, simple in construction, inexpensive to manufacture, and capable of long life of useful service.

A further object of the present invention is to provide a tablet counter having a switching device, coupled to each of a plurality of tablet detecting circuits, to limit detector saturation and tablet undercounting.

A further object of the present invention is the provision of a tablet counter having a plurality of inverters with hysteresis individually coupled to a plurality of switching devices, for providing circuit noise immunity and decreasing tablet overcounting.

The term "tablet" is used hereinafter for convenience, since that is the most common use for the present invention, but should be construed broadly as including pills, capsules and any other small articles of substantially uniform size and shape that need to be counted, such as nuts and washers.

The foregoing and other objects, features, and advantages of the invention will become more readily apparent from the following detailed description of a preferred embodiment of the invention which proceeds with reference to the accompanying drawings.

BRIEF DESCRIPTION OF THE DRAWINGS

FIG. 1 is a vertical section through the mechanical part of the apparatus of the present invention.

FIG. 2 is a top plan view of the apparatus shown in FIG. 1.

FIG. 3 is a horizontal section taken at lines 3—3 of FIG. 1.

DETAILED DESCRIPTION

Figure 4:
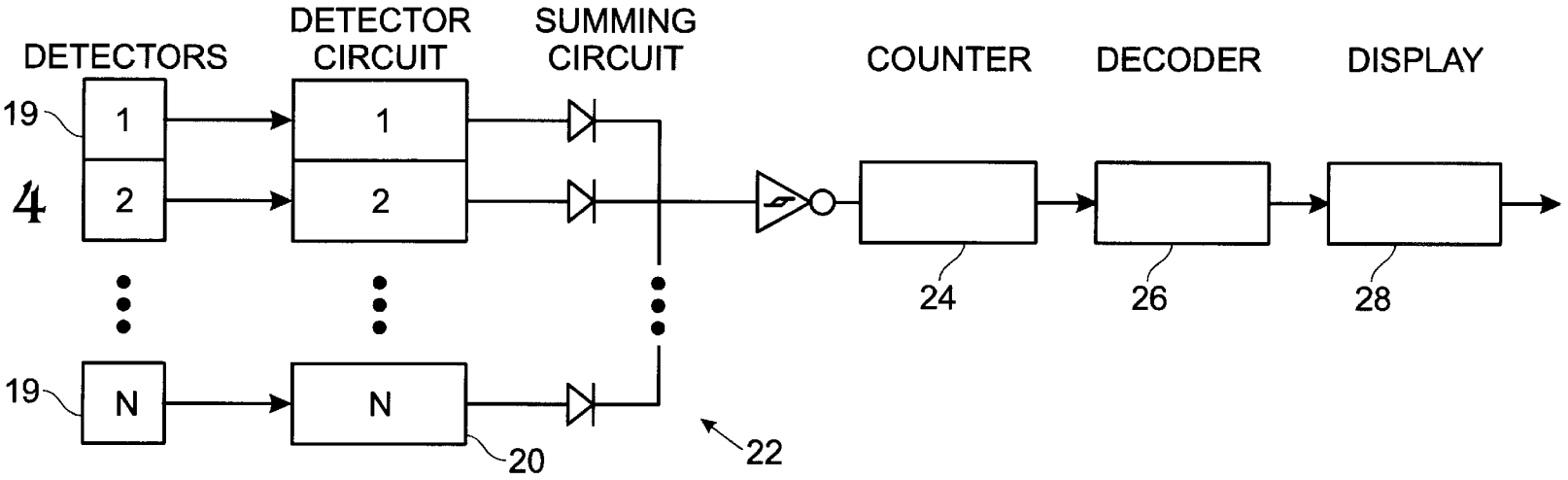
FIG. 4 is a block schematic diagram of the detectors, detector circuits and summing circuit, and counter employed in the present invention.

The description in conjunction with the foregoing figures encompasses various configurations and applications and more specifically discusses a preferred embodiment of the invention.

The general structure and operation of the tablet counter shown in FIGS. 1—3 is described in detail in my U.S. Pat. No. 3,789,194, entitled "RELATING TO COUNTING MACHINES," granted Jan. 29, 1974, incorporated herein by reference. Briefly summarizing, the tablet counter mechanical structure includes a tablet feeder assembly including a hopper for receiving a plurality of tablets, and means for dispersing a flow of tablets approximately evenly among a plurality of channels into separate streams of tablets. The preferred mechanical structure, as shown in FIGS. 1–3, comprises a vertically disposed, cylindrical casing 11 of circular cross section and a vertically disposed, cylindrical inlet passage 12, also of circular cross section, mounted coaxially on top of the casing. A series of spaced annuli 13 are secured to the internal wall of the passage and have upper surfaces 14 which taper downwardly and inwardly.

Mounted coaxially in the casing 11, vertically below the annuli 13, is a dispersing cone 15. An annular passage 16 is defined between the periphery of the base of the cone 15 and the internal wall of the casing 11, and is divided into open-bottomed compartments 17 by a series of radial partitions 18.

A photocell 19 is mounted just below the bottom of each compartment 17 adjacent the wall of casing 11, and a light source for the photocells is mounted on the axis of casing 11 in substantially the same horizontal plane as the photocells. A collecting chamber 21 and drawer 22 are provided at the bottom of the machine.

The operation of the mechanical part of the tablet counter shown in FIGS. 1–3 is not particular to the present invention and so is not discussed in further detail. Other apparatus known in the art could also be used to perform the same mechanical function, e.g., U.S. Pat. Nos. 3,928,753; 4,012,622; 4,396,828; 4,901,841; and 5,317,645, among others. Other physical arrangements of the photocells could also be used, such as an individual light source for each detector.

FIG. 4 shows the overall structure of the detection, summing and counting circuitry used in the present invention. This circuit includes the plurality of photocells 19 serving as detectors to produce detect signals as tablets pass the detectors 19. A detector circuit 20 is coupled to each of the photocells 19 to shape the output signal into an output detect signal, as further described below. A summing circuit 22 combines the output signals from the plurality of detector circuits and then inputs the combined output signal as a train of pulses to a counter 24. The counter counts the pulses in the combined output signal. The counter produces a digital output signal which is input to a decoder to drive a digital display 28. Additional circuitry similar to that shown in my prior U.S. Pat. No. 3,789,194, is used for self testing overspeed control and power but, not being pertinent to the present invention, is not further described herein.

Figure 5:
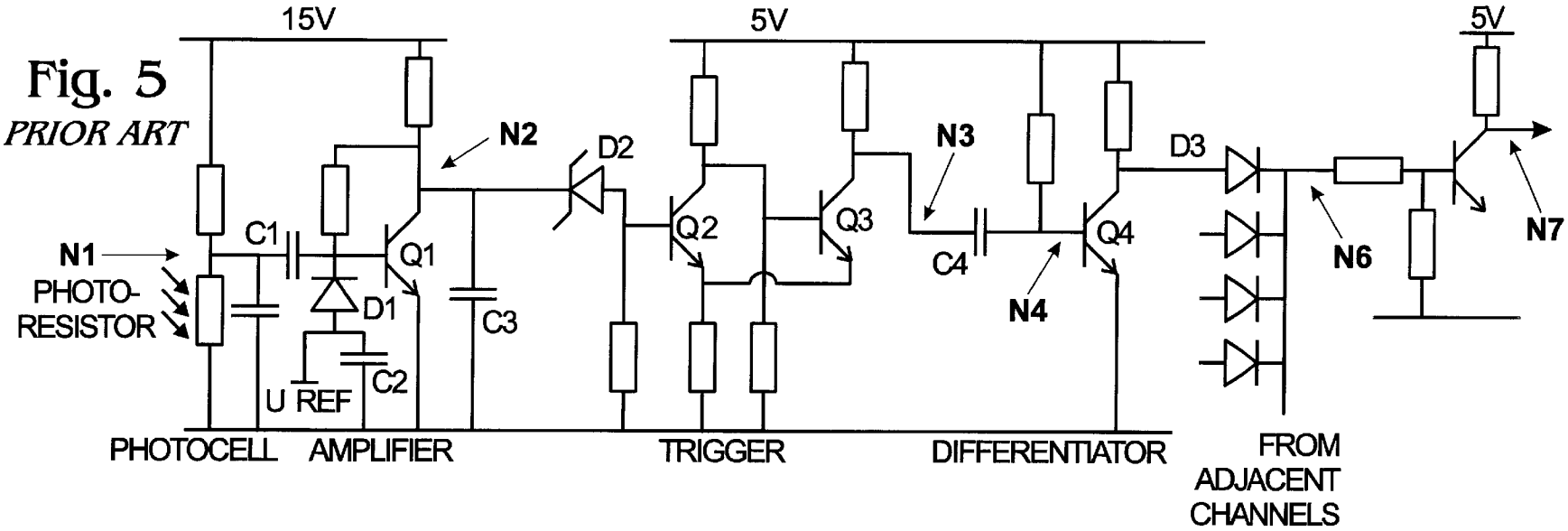
Fig. 5 PRIOR ART
FIG. 5 shows more detailed diagram of a detector and first detector circuit, and summing circuit employed in the prior art.
Figure 8A:
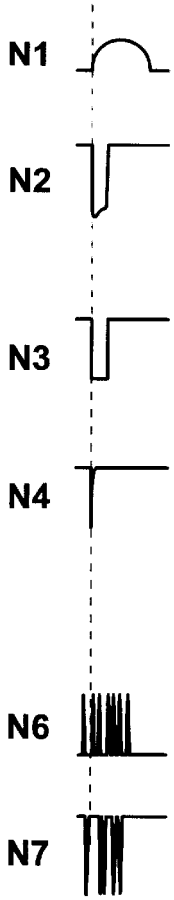
FIG. 8A–C are columns of signal traces comparing the signals at various corresponding nodes of the circuits of FIGS. 5, 6 and 7.

Referring to the prior art circuit of FIG. 5, the signals produced at each node N1, N2, etc are shown in a column in FIG. 8A. The detect signal appearing at node N1 rests at about 7.5v and varies in amplitude from 0.2v to 2.0v and in duration from 5 mS to 20 mS. The signal is filtered and passed through an amplifier transistor Q1 to produce a signal at node N2 which rests at 9v because it is clamped by an 8.2v zener diode. The unclamped level of the collector Q1 (if the zener diode is removed) is about 11.5v. This provides a 2.5v noise margin and also allows for variation in the gain of transistor Q1. The signal is then passed to node N3 via transistors Q2 and Q3 coupled to form a Schmidt trigger. When the collector of transistor Q1 falls below 9v, transistor Q2 is switched off and transistor Q3 is switched on. Then, at node N4, the falling edge of the transistor Q3 output is differentiated to give negative pulse of a width of about 1 microsecond. The signals from multiple such detector circuits are then summed by a diode summing circuit to produce a pulse train at node N6, inverted by an output transistor for transmittal to the counter at node N7.

The FIG. 5 circuit differentiates once before the detection stage, which is the input to the Schmidt trigger, at the base of transistor Q2. Thus, it is the rising edge of the photocell detect signal that is detected. The falling edge of the detect signal produces no (+ve) signal at node N2 because it is clamped at 9v by the zener diode. The Schmidt trigger provides hysteresis in this circuit. The main problem with the FIG. 5 circuit is that no measures are taken to counteract saturation of the amplifier when a very large tablet or bunch of tablets passes the photocell. This causes a refractory period in which tablets might pass uncounted. This circuit could not reliably count tablets at faster than 30/sec. without the error rate rapidly exceeding 0.003. Another problem is that this design used transistors, the characteristics of which vary widely, even in the same batch.

Figure 6:
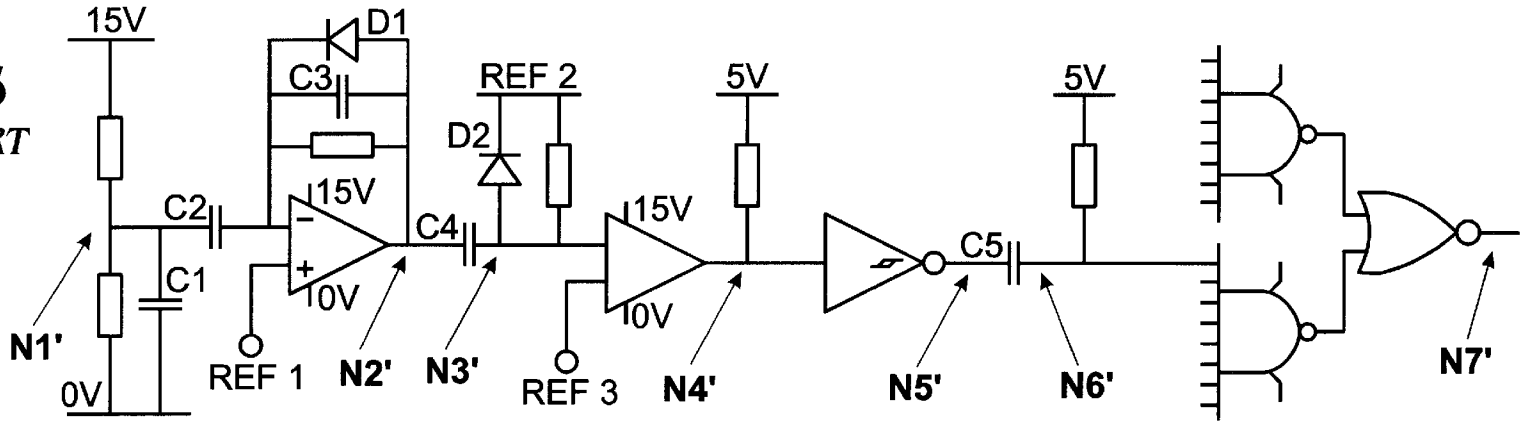
Fig. 6 PRIOR ART
FIG. 6 shows more detailed diagram of a detector and second detector circuit, and summing circuit employed in the prior art.
Figure 8B:
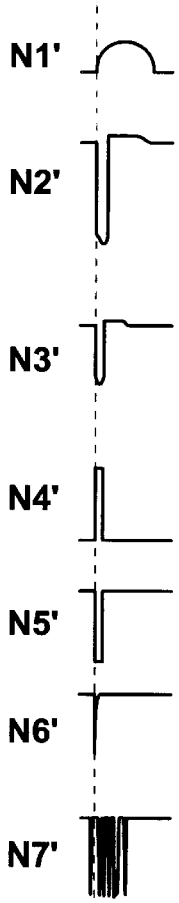

The FIG. 6 circuit was developed to overcome some of these problems. The same photocell detect signal is shown for node N1' in FIG. 8B and is input to an LM324 comparator. At node N2' the comparator output signal rests at about 8v, and falls upon the rise of the detect signal from the photocell. Positive excursion of this signal above the resting level is clamped by diode D1. This signal is filtered to produce the signal shown at node N3' which rests at the voltage of REF 2, about 450 mv above REF 3. The signal falls on the initial curvature of the photocell detect signal, that is, the second derivative of the waveform at node N1'. This signal is in turn passed through a LM339 comparator to node N4'. When the signal at node N3' drops below REF 3, the output at node N4' rises. The edge of the output signal from the comparator is not fast enough to put straight into a differentiator if the output detect signal at node N6' is to be short enough. Therefore, the signal is passed through a 7414 Schmidt trigger inverter, which has an output at node N5' fast enough for the short time constant (1 microsecond) of the final differentiator. Passing through the differentiator C5 the differentiated falling edge of the Schmidt trigger output is 1 microsecond. The resulting pulses are summed by logical OR circuitry (8-input NAND gates) and the combined pulse train is sent to the counter.

The FIG. 6 circuit still has a number of problems, which limit its counting speed to about 40/sec. at an error rate of 0.003, and broaden the deviation of errors to include both overcounts and undercounts. No measures are taken to prevent saturation of the amplifier; undercounts are still possible when multiple tablets coincidentally pass a photocell. There is no positive feedback, and therefore no hysteresis, on the second comparator, which can lead to multiple overcounts on a noisy signal. At node N6', a differentiated signal edge gives an exponential rise. The 8-input NAND gates would preferably have Schmidt trigger inputs but these are not available in this design.

Moreover, the FIG. 6 design has too many stages and components. The signal is differentiated twice before the detection stage, which means that it is the curvature of the start of the rising edge of the photocell detect signal which is being detected. This is unnecessary. There is only one rising edge in each photocell detect signal, just as there is only one initial curvature, so it should be possible to accomplish detection with the signal feature that require only one differentiation stage, that is, a slope rather than curvature. This rationale applies as much to overlapping tablet detect signals as well as to separated detect signals.

Figure 7:
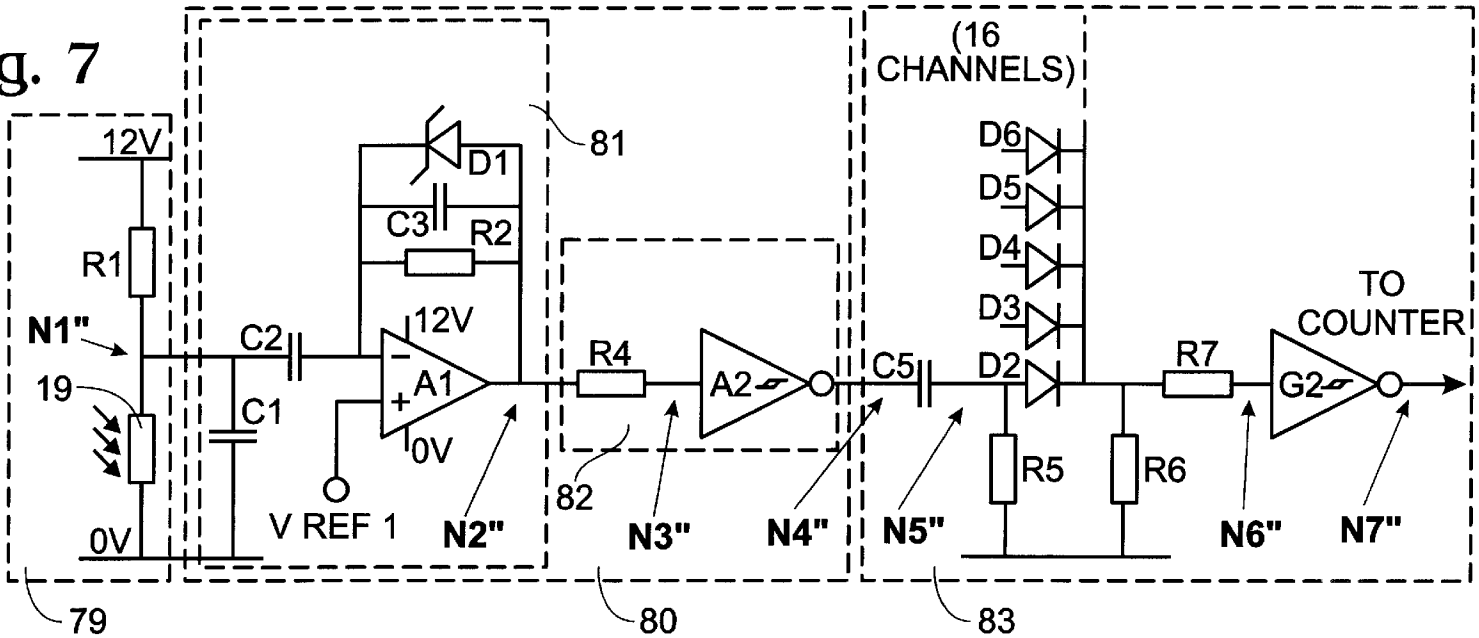
FIG. 7 is a more detailed circuit diagram of a photodetector, detecting circuit, and summing circuit according to the present invention.
Figure 8C:
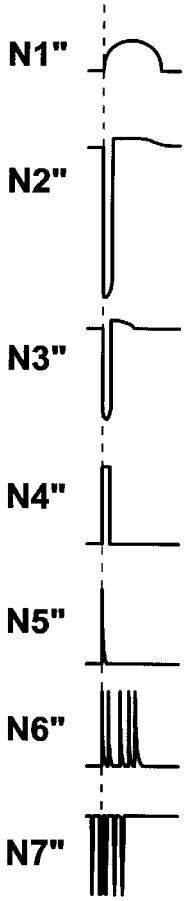

FIG. 7 shows a detailed circuit diagram of the photodetector circuit 79, detecting circuit 80, and summing circuit 83 according to the present invention. FIG. 8C shows the signals at various nodes in the circuit in comparison to the signals in FIG. 8A and 8B.

The tablet counter of the present invention has sixteen separate photodetector circuits 79 coupled to sixteen respective detecting circuits 80 which, in turn, are coupled to a single summing circuit 83. Detecting circuit 80 comprises an amplifying circuit 81 and an inverting circuit 82, for processing the detect signal received from the photocell 19 via node N1". These circuits are described further below. Solely for purposes of illustrative example of an operative circuit which implements the present invention, and not by way of limitation, component values and part identifications are listed in parentheses in the following description.

As a stream of tablets falls through the counter assembly of FIGS. 1–3, each tablet passes through the light beam between the light source 10 (shown in FIGS. 1–3) and photodetector 19. A first terminal of photodetector 19 (approximately 4K) is connected to a first voltage supply, typically ground or 0v, while a second terminal is connected to resistor R1 (47K) which, in turn, is connected in series to a second voltage supply (12v). Resistor R1 allows current to flow from the second voltage supply into photodetector 19. The disruption of light caused by the falling tablet causes the current flowing through photodetector 19 to change, producing a rising edge detect signal at input node N1" of detecting circuit 80. The voltage signal produced at N1" as a tablet passes in front of photodetector 19 is shown in FIG. 8C. This signal rests at about 6v. Tablet signals vary in amplitude from 0.2v to 2v and in duration from 5 mS to 20 mS. The rising edge dv/dt (max) ranges from 10 v/sec. to 50 v/sec.

Amplifying circuit 81 comprises a bypass capacitor C1 (22 nF) to ground, a series capacitor C2 (150 nF), and an operational amplifier A1 (LM324) with resistor R2 (3.3M), capacitor C3 (150 pF), and zener diode D1 connected in parallel to each other and across the output and negative input of amplifier A1, as shown in FIG. 7. Amplifying circuit 81 amplifies, inverts, and filters the rising edge photodetector signal, creating a short duration voltage pulse at output node N2" of amplifying circuit 81. The voltage pulse produced at node N2" as a tablet passes in front of the photodetector 19 is shown in FIG. 8C. Amplifying circuit 81 output at node N2" rests at a voltage determined by VREF1, typically set to 10v, and falls when the photocell detect signal rises, as can be seen at N2"" of FIG. 8C. The gain of amplifier A1 is set so that the smallest signal to be detected without becoming too susceptible to noise, typically 5v/sec. on the detect signal, will swing the output down from 10v to about 1.3v. This is just below the threshold of inverter A2 (74HC14), which is 1.7v on the falling edge.

Amplifying circuit 81 includes a zener diode D1 (9v) coupled from the output to the negative input of amplifier A1. The zener diode D1 clamps the output of amplifier A1 to within a diode drop of the reference voltage VREF1 in the positive direction and to within 9V in the negative direction. The higher VREF1 is set, (and therefore the higher the gain must be to bring the minimum signal down to 1.3v), the less "stiffness" in the circuit. Thus, amplifier A1 cannot saturate and the consequent amplifier refractory period is avoided when a very large tablet or bunch of tablets passes in front of the photodetector. Since the gain can be set high without causing the amplifier to saturate, gain settings high enough to detect values of dv/dt as low as 5v/sec. (which is as sensitive as the circuit can be set without becoming too susceptible to noise).

Therefore, the counter detector circuitry is able to distinguish two tablets when they are bunched together and produce two distinct detect signals, as is shown in the two diagrams of FIG. 9. The result is improved counting accuracy and speed. In effect, amplifying circuit 81 deals with every photodetector signal as though it came from the smallest tablet to be detected.

Inverting circuit 82 is coupled to amplifying circuit 81 and comprises a resistor R4 (22K) and an inverter A2 (74HC14), as shown in FIG. 7. Inverter A2 is a Schmidt trigger inverter with hysteresis. Resistor R4 limits the amount of current through the internal clamping diode in inverter A2, clamping the inverter A2 input signal at node N3" to about 5v. The voltage signal at node N3" is shown in FIG. 8C. When the node N3" signal input to inverter A2 falls below a specified turn-on level, typically 1.7v in this circuit, inverter A2 produces an inverted output that does not change until the node N3" signal level rises above a specified turn-off level, typically 2.8v. The resultant hysteresis provides a high level of immunity against signal noise spikes that could prevent false counts, thereby improving tablet counter accuracy by reducing overcounts.

The inverted signal produced at node N4", which is input to summing circuit 83, is shown in FIG. 8C. Summing circuit 83 is coupled to the output of inverting circuit 81 and comprises capacitor C5 and resistor R5 which have a time constant of approximately $10^{-7}$ sec., a diode OR gate including diode D2, damping resistors R6 and R7 coupled to ground or 0v, and inverting gate G2, as shown in FIG. 7. The rising edge of the Schmidt trigger inverter output at node N4" is differentiated by the combination of R5 and C5 to produce a narrow pulse at N5", as can be seen in FIG. 8C. The diode OR gate comprises sixteen diodes similar to diode D2, as can be seen in FIG. 7 for the 16-channel counter of FIGS. 1–3. Each of the sixteen diodes, like diode D2, is coupled to a respective detector 79 and detecting circuit 80.

As the pulse at node N4" travels through capacitor C5 and resistor R5, the output pulse duration is decreased by the differentiation and the resulting output detect pulse is fed into diode D2. The outputs produced in the additional fifteen detecting circuits are similarly fed into the respective individual diodes D3, D4, D5, etc. Diode D2 outputs a single summed output signal at node N6" which is a train of pulses produced by the logical-OR of the sixteen individual detect signals. The diode OR gate feeds this composite signal through inverting gate G2 (Schmidt trigger inverter 74HC14) to the counter circuit 24 (FIG. 4) which counts the number of tablets, i.e., pulses, passing through the detectors. The signal produced at node N6" and the inverted pulse train at node N7" are shown in FIG. 8C.

Figure 9A:
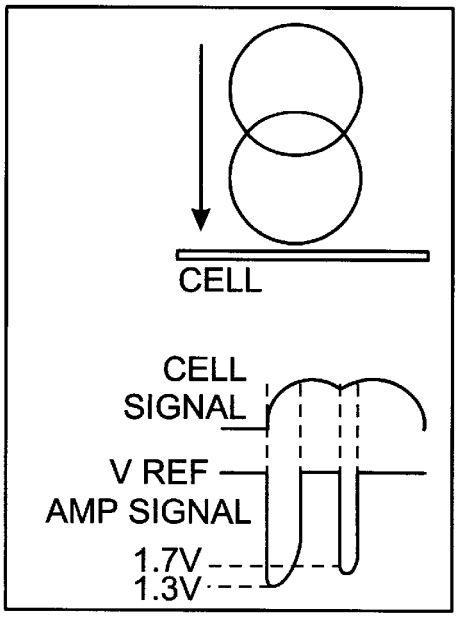
FIG. 9A and 9B show photodetector voltage signals in two cases of two tablets being bunched together as they pass the photodetector.
Figure 9B:
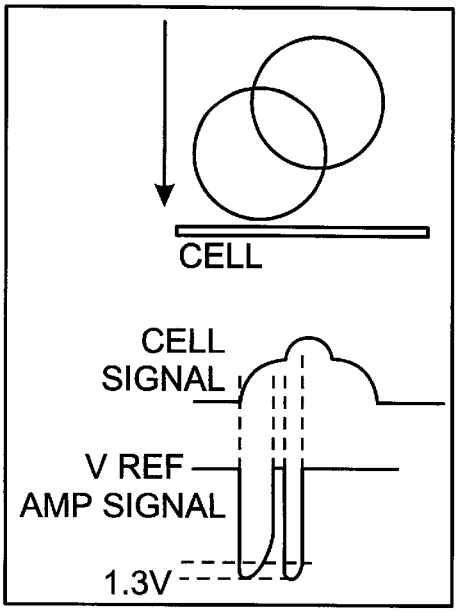

The resulting circuit has an improved noise immunity, virtually eliminating overcount errors, and reduces undercount errors due to nearly coincident tablets passing each detector (FIGS. 9A and 9B). The counting rate can be increased to the range of 60–70/sec. at an error rate less than 0.003.

Having described and illustrated the principles of the invention in a preferred embodiment thereof, it should be apparent that the invention can be modified in arrangement and detail without departing from such principles.

I claim all modifications and variations coming within the spirit and scope of the following claims:

1. A machine for counting discrete tablets, comprising:

a feeder including a hopper for receiving a plurality of tablets and means for dispersing a flow of tablets to be counted approximately evenly among a plurality of channels, each channel having a falling stream;

a plurality of detectors individually associated with each channel for detecting each of the tablets passing down each falling stream and generating a detect signal which varies as discrete tablets passing down each stream interrupt a beam of light from a light source to the respective receiver;

a plurality of detecting circuits, each detecting circuit individually coupled to a respective detector to receive the detect signal therefrom and produce a detector output signal;

a counter coupled to said plurality of detecting circuits for counting the detector output signals for the total number of tablets in all of the streams; and a switching device coupled to each of said plurality of detecting circuits to limit detector saturation and tablet under-counting.

2. A machine for counting discrete tablets according to claim 1 wherein each of said detecting circuits comprises:

an amplifier circuit having an input coupled to the respective detector; and each switching device includes an inverter with hysteresis coupled to said amplifier circuit for providing detecting circuit noise immunity and decreasing tablet over-counting; and a resistor coupled between said amplifier circuit and said inverter to provide greater noise margin than if the amplifier had been directly coupled to the inverter by limiting current input to said inverter.

3. A machine for counting discrete tablets according to claim 2 wherein said inverter with hysteresis is a schmidt trigger inverter.

4. A machine for counting discrete tablets according to claim 1 wherein the switching device is a zener diode.

5. A machine for counting discrete tablets according to claim 1 wherein said counter comprises a logic circuit having a plurality of inputs individually coupled to a respective detector and generating a counter signal representing the logical-OR of the individual detect signals.

6. A machine for counting discrete tablets according to claim 5 wherein said logic circuit comprises a plurality of diodes.

7. A machine for counting discrete tablets, comprising:

a feeder including a hoper for receiving a plurality of tablets and means for dispersing a flow of tablets to be counted substantially evenly among a plurality of channels, each channel having a falling stream;

a plurality of detectors individually associated with each falling stream for detecting each of the tablets passing down each stream, each of said plurality of detectors coupled to a detector voltage supply;

a counter coupled to said plurality of detectors for counting the total number of tablets in all of the streams;

a plurality of detecting circuits individually coupled to each of said plurality of detectors and generating a tablet detect signal for each of the tablets in each of the channels;

a switching device coupled to each of said plurality of detecting circuits for preventing detecting circuit response delay and saturation; and a device with hysteresis coupled to said plurality of detecting circuits for providing detecting circuit noise immunity.

8. A machine for counting discrete tablets according to claim 7 wherein said inverter with hysteresis is a schmidt trigger inverter.

9. A machine for counting discrete tablets according to claim 7 wherein the switching device is a zener diode.

10. A machine for counting discrete tablets according to claim 7 said counter comprises a logic circuit having a plurality of inputs individually coupled to a respective detector and generating a counter signal representing the logical-OR of the individual tablet detect signals.

11. A machine for counting discrete tablets according to claim 10 wherein said logic circuit comprises a plurality of diodes.

12. A method of counting discrete tablets with a high level of accuracy and improved speed, which comprises:

receiving a plurality of tablets to be counted in a hopper;

dispersing the plurality of tablets received substantially evenly among a plurality of channels, each channel having a stream;

producing a voltage signal for each of the tablets passing down each falling stream;

amplifying the voltage signal produced using an operational amplifier; and clamping the amplified voltage signal produced below a voltage level corresponding to the voltage level at which the operational amplifier circuit saturates; and counting the total number of voltage signals produced for all of the tablets passing down all streams.

13. A method of counting discrete tablets with a high level of accuracy and improved speed according to claim 12 further comprises providing the amplified voltage signal with hysteresis for improving electrical signal noise immunity.

14. A method of counting discrete tablets with a high level of accuracy and improved speed according to claim 13 wherein providing the amplified voltage signal with hysteresis is accomplished using a schmidt trigger inverter.

15. A method of counting discrete tablets with a high level of accuracy and improved speed according to claim 14 wherein clamping the amplified voltage signal is accomplished using a zener diode.

* * * * *